US007275519B2

(12) United States Patent
Miyazaki et al.

(10) Patent No.: US 7,275,519 B2
(45) Date of Patent: Oct. 2, 2007

(54) CONTROL APPARATUS FOR INTERNAL COMBUSTION ENGINE

(75) Inventors: Kazuma Miyazaki, Toyota (JP); Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/360,392

(22) Filed: Feb. 24, 2006

(65) Prior Publication Data

US 2006/0207562 A1 Sep. 21, 2006

(30) Foreign Application Priority Data

Mar. 18, 2005 (JP) ..... 2005-079258

(51) Int. Cl.
*F02D 41/30* (2006.01)
*F02D 41/06* (2006.01)

(52) U.S. Cl. ..... 123/431; 123/435

(58) Field of Classification Search ..... 123/431, 123/435

See application file for complete search history.

(56) References Cited

U.S. PATENT DOCUMENTS

| | | | |
|---|---|---|---|
| 5,924,405 A | 7/1999 | Hashimoto | |
| 6,062,189 A | 5/2000 | Kaneko et al. | |
| 6,340,016 B1 | 1/2002 | Ueda et al. | |
| 6,505,603 B1 | 1/2003 | Schray et al. | |
| 2006/0207556 A1* | 9/2006 | Miyazaki et al. | 123/431 |

FOREIGN PATENT DOCUMENTS

| | | |
|---|---|---|
| EP | 0 849 455 A2 | 6/1998 |
| EP | 0 849 459 A1 | 6/1998 |
| EP | 1 036 928 A2 | 9/2000 |
| JP | A 62-258140 | 11/1987 |
| JP | A 63-085238 | 4/1988 |
| JP | A 2002-227697 | 8/2002 |
| JP | A-2002-364409 | 12/2002 |
| JP | A-2005-069049 | 3/2005 |

* cited by examiner

*Primary Examiner*—T. M. Argenbright
(74) *Attorney, Agent, or Firm*—Oliff & Berridge, PLC

(57) ABSTRACT

At the time of startup of an engine having an in-cylinder injector and an intake manifold injector, a risk of pre-ignition during the first-time compression stroke is determined based on a rotational angle of a crankshaft at the time of previous engine stop. When there is a high risk of pre-ignition, fuel injection from the in-cylinder injector having been set to make an air-fuel ratio within the combustion chamber become out of a range enabling combustion (to attain an over-rich condition) is carried out in addition to fuel injection from the intake manifold injector for normal engine startup. Pre-ignition is thus prevented, and smooth engine startup is ensured.

18 Claims, 6 Drawing Sheets

| CRANK ROTATION ANGLE | | FIRST-TIME REVOLUTION | | SECOND-TIME REVOLUTION | |
|---|---|---|---|---|---|
| | | 0-180 DEGREES | 180-360 DEGREES | 360-540 DEGREES | 540-720 DEGREES |
| CYLINDER | #1 | COMBUSTION | EXHAUST | INTAKE | COMPRESSION |
| | #2 | COMPRESSION | COMBUSTION | EXHAUST | INTAKE |
| | #3 | EXHAUST | INTAKE | COMPRESSION | COMBUSTION |
| | #4 | INTAKE | COMPRESSION | COMBUSTION | EXHAUST |

CONTROL APPARATUS FOR INTERNAL COMBUSTION ENGINE

This nonprovisional application is based on Japanese Patent Application No. 2005-079258 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine, and more particularly to fuel injection control at the time of startup of an internal combustion engine provided with a first fuel injection mechanism (in-cylinder injector) for injecting fuel into a cylinder (into a combustion chamber) and a second fuel injection mechanism (intake manifold injector) for injecting fuel into an intake manifold and/or an intake port.

2. Description of the Background Art

An internal combustion engine having an in-cylinder injector for injecting fuel directly into a combustion chamber and an intake manifold injector for injecting fuel into an intake port (intake manifold) of each cylinder has been proposed. A control apparatus for such an internal combustion engine that carries out fuel injection using both of the in-cylinder injector and the intake manifold injector during a homogeneous combustion operation has also been proposed (e.g., Japanese Patent Laying-Open No. 2002-364409; hereinafter, referred to as "Patent Document 1"). In particular, Patent Document 1 discloses a configuration where fuel injection via the in-cylinder injector is ensured so as to suppress fuel deposition therein due to an increase in temperature of its tip end.

Meanwhile, in the engine cold state, vaporization of the fuel inside the cylinder is unlikely to be promoted. Thus, if fuel is injected via the in-cylinder injector, a large quantity of the fuel may deposit on the top surface of the engine piston and on the inner peripheral surface of the cylinder. The fuel thus deposited may degrade the exhaust emission performance due to occurrence of graphite or increase of unburned components, or may degrade the lubrication performance due to mixing with the lubricating oil of the engine piston. Therefore, it is preferable to avoid fuel injection via the in-cylinder injector during the engine cold state.

SUMMARY OF THE INVENTION

As described above, in an internal combustion engine using both the in-cylinder injector and the intake manifold injector, the fuel injection ratio between the cylinders should be set in accordance with the engine conditions (temperature, number of revolutions, load and the like). Particularly, at the time of engine startup, the engine output is small, so that it is necessary to properly set the fuel injection ratio according to the engine temperature.

At the time of engine startup during the engine cold state, however, the residual fuel within the cylinder due to fuel leakage from the in-cylinder injector while the operation of the internal combustion engine is being stopped, for example, may cause pre-ignition where the fuel ignites prior to an ignition timing because of the compression operation when the piston starts operation.

Further, at the time of engine startup during the engine warm state, knocking may occur due to an excessively high temperature inside the combustion chamber.

Accordingly, in an internal combustion engine having both an in-cylinder injector and an intake manifold injector, it is preferable that the fuel injection ratio between the two kinds of injectors is set appropriately so as to stabilize combustion control at the time of startup, taking the above-described points into consideration.

The present invention has been made to solve the above-described problems. An object of the present invention is to ensure smooth startup of an internal combustion engine provided with a first fuel injection mechanism (in-cylinder injector) for injecting fuel into a cylinder and a second fuel injection mechanism (intake manifold injector) for injecting fuel into an intake manifold and/or an intake port, by preventing occurrence of pre-ignition and knocking.

A control apparatus for an internal combustion engine according to the present invention is a control apparatus for an internal combustion engine having a first fuel injection mechanism for injecting fuel into a combustion chamber and a second fuel injection mechanism for injecting fuel into an intake manifold for a cylinder, and includes a fuel injection control portion and a pre-ignition detecting portion. The fuel injection control portion controls fuel injection from the first and second fuel injection mechanisms. The pre-ignition detecting portion detects a risk of pre-ignition during a first-time compression stroke of the cylinder, at the time of startup of the internal combustion engine, based on a stopped position of a piston at the time of previous stop of the internal combustion engine. The fuel injection control portion includes a startup-time control portion and a pre-ignition preventing portion. The startup-time control portion causes one of the first and second fuel injection mechanisms to inject fuel of a quantity required for operation of the internal combustion engine at the time of startup of the internal combustion engine. The pre-ignition preventing portion causes the other one of the first and second fuel injection mechanisms to inject fuel of a prescribed quantity that is set to make an air-fuel ratio within the combustion chamber become out of a range enabling combustion (combustion limit) when the pre-ignition detecting portion detects a high risk of pre-ignition.

According to this control apparatus for an internal combustion engine, at the time of startup of the internal combustion engine, fuel injection is carried out via one fuel injection mechanism. When there is a high risk of occurrence of pre-ignition, fuel injection (in-cylinder injection) is additionally carried out via the other fuel injection mechanism so as to set the air-fuel ratio within the combustion chamber out of the range enabling combustion. Accordingly, at the time of startup of the internal combustion engine, pre-ignition can be prevented to ensure smooth startup thereof Preferably, in the control apparatus for an internal combustion engine of the present invention, the startup-time control portion causes the second fuel injection mechanism to inject fuel of the quantity required for operation of the internal combustion engine at the time of startup of the internal combustion engine during the cold state. Further, the pre-ignition preventing portion causes the first fuel injection mechanism to inject fuel of the prescribed quantity during the first-time compression stroke when the pre-ignition detecting portion detects a high risk of pre-ignition at the time of startup of the internal combustion engine during the cold state.

According to this control apparatus for an internal combustion engine, at the time of startup of the internal combustion engine during the engine cold state, fuel injection from the second fuel injection mechanism (i.e., port injection) is basically carried out. When there is a high risk of occurrence of pre-ignition, fuel injection from the first fuel injection mechanism (i.e., in-cylinder injection) is additionally carried out. As a result, while degradation in exhaust emission performance as well as in lubrication performance is suppressed by basically conducting startup with port injection, occurrence of pre-ignition can be prevented as well. Accordingly, it is possible to prevent pre-ignition during the engine cold state to ensure smooth startup of the internal combustion engine.

Still preferably, in the control apparatus for an internal combustion engine of the present invention, the pre-ignition detecting portion detects the risk of pre-ignition by estimating the stopped position of the piston from an output of a crank angle sensor at the time of previous stop of the internal combustion engine.

According to this control apparatus for an internal combustion engine, it is possible to efficiently determine the risk of occurrence of pre-ignition, without arrangement of new equipment such as an air-fuel ratio sensor, taking account of the fact that pre-ignition is caused primarily due to the fuel leaked from the in-cylinder injector during the engine stop.

Alternatively, in the control apparatus for an internal combustion engine of the present invention, the internal combustion engine may have a plurality of cylinders, and the pre-ignition detecting portion selectively identifies a cylinder having a high risk of pre-ignition from among the plurality of cylinders.

According to this control apparatus for an internal combustion engine, in the internal combustion engine having a plurality of cylinders, the cylinder(s) having a high risk of pre-ignition can be located, and additional fuel injection from the first fuel injection mechanism (in-cylinder injection) can be carried out for the relevant cylinder(s) to prevent pre-ignition. This ensures smooth startup of the internal combustion engine during the engine cold state.

A control apparatus for an internal combustion engine according to another configuration of the present invention is a control apparatus for an internal combustion engine having a first fuel injection mechanism for injecting fuel into a combustion chamber and a second fuel injection mechanism for injecting fuel into an intake manifold for a cylinder, and includes a fuel injection control portion and a knocking detecting portion. The fuel injection control portion controls fuel injection from the first and second fuel injection mechanisms. The knocking detecting portion detects a risk of occurrence of knocking in the cylinder, at the time of startup of the internal combustion engine, based on a temperature within the combustion chamber. The fuel injection control portion includes a startup-time control portion and a knocking preventing portion. The startup-time control portion causes at least one of the first and second fuel injection mechanisms to inject fuel of a quantity required for operation of the internal combustion engine at the time of startup of the internal combustion engine. The knocking preventing portion operates when a high risk of occurrence of the knocking is detected by the knocking detecting portion at the time of startup of the internal combustion engine, and sets fuel injection from the first fuel injection mechanism such that a cooling effect within the combustion chamber by vaporization of the injected fuel is enhanced.

According to this control apparatus for an internal combustion engine, at the time of startup of the internal combustion engine, if there is a high risk of occurrence of knocking, in-cylinder injection is carried out so as to enhance the cooling effect within the combustion chamber by vaporization of the injected fuel. In this manner, the temperature within the combustion chamber is decreased, and thus, occurrence of knocking at the time of startup of the internal combustion engine can be prevented.

Preferably, in the control apparatus for an internal combustion engine according to the other configuration of the present invention, the startup-time control portion causes the first fuel injection mechanism to inject fuel of the quantity required for operation of the internal combustion engine at the time of startup of the internal combustion engine during a warm state. Further, the knocking preventing portion sets the fuel injection from the first fuel injection mechanism to be carried out during a compression stroke at the time of startup of the internal combustion engine during the warm state.

According to this control apparatus for an internal combustion engine, at the time of startup of the internal combustion engine during the engine warm state, fuel injection from the first fuel injection mechanism (i.e., in-cylinder injection) is basically carried out. When there is a high risk of occurrence of knocking, in-cylinder injection is carried out during the compression stroke. Injection during the compression stroke can reduce the time from the timing of fuel injection to the timing of ignition, so that the cooling effect within the combustion chamber by vaporization of the injected fuel is enhanced. This suppresses the risk of knocking. As such, during the engine warm state, the startup of the internal combustion engine is basically carried out with in-cylinder injection to prevent clogging of the first fuel injection mechanism (in-cylinder injector), and additionally, occurrence of knocking is prevented to ensure smooth startup of the internal combustion engine.

Alternatively, in the control apparatus for an internal combustion engine according to the other configuration of the present invention, the fuel injection control portion may further include a startup-time fuel injection correction portion. The startup-time fuel injection correction portion increases the quantity of the fuel injected from the first fuel injection mechanism at the time when the knocking preventing portion is in operation than at the time when the knocking preventing portion is not in operation.

According to this control apparatus for an internal combustion engine, the quantity of the fuel injected from the first fuel injection mechanism is increased to compensate for the decrease of engine output torque that is expected when in-cylinder injection is carried out during the compression stroke for the purpose of preventing knocking. Accordingly, the engine startup during the engine warm state can further be smoothed.

Still alternatively, in the control apparatus for an internal combustion engine according to the other configuration of the present invention, the fuel injection control portion may further include a startup-time fuel injection correction portion. The startup-time fuel injection correction portion causes injection of fuel of a prescribed quantity from the second fuel injection mechanism to be carried out in addition to injection of the fuel of the quantity required for operation of the internal combustion engine from the first fuel injection mechanism at the time when the knocking preventing portion is in operation.

According to this control apparatus for an internal combustion engine, fuel injection of a prescribed quantity from the second fuel injection mechanism (port injection) is added to compensate for the decrease of engine output torque that is expected when in-cylinder injection is carried out during the compression stroke for the purpose of preventing knocking. Accordingly, the engine startup during the engine warm state can further be smoothed.

Preferably, in the control apparatus for an internal combustion engine according to the other configuration of the present invention, the knocking detecting portion detects the risk of occurrence of the knocking based on at least one of a coolant temperature and an intake air temperature of the internal combustion engine.

According to this control apparatus for an internal combustion engine, the risk of knocking can be detected efficiently by using outputs of the sensors for measuring the coolant temperature and the intake air temperature that are normally provided in the internal combustion engine.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
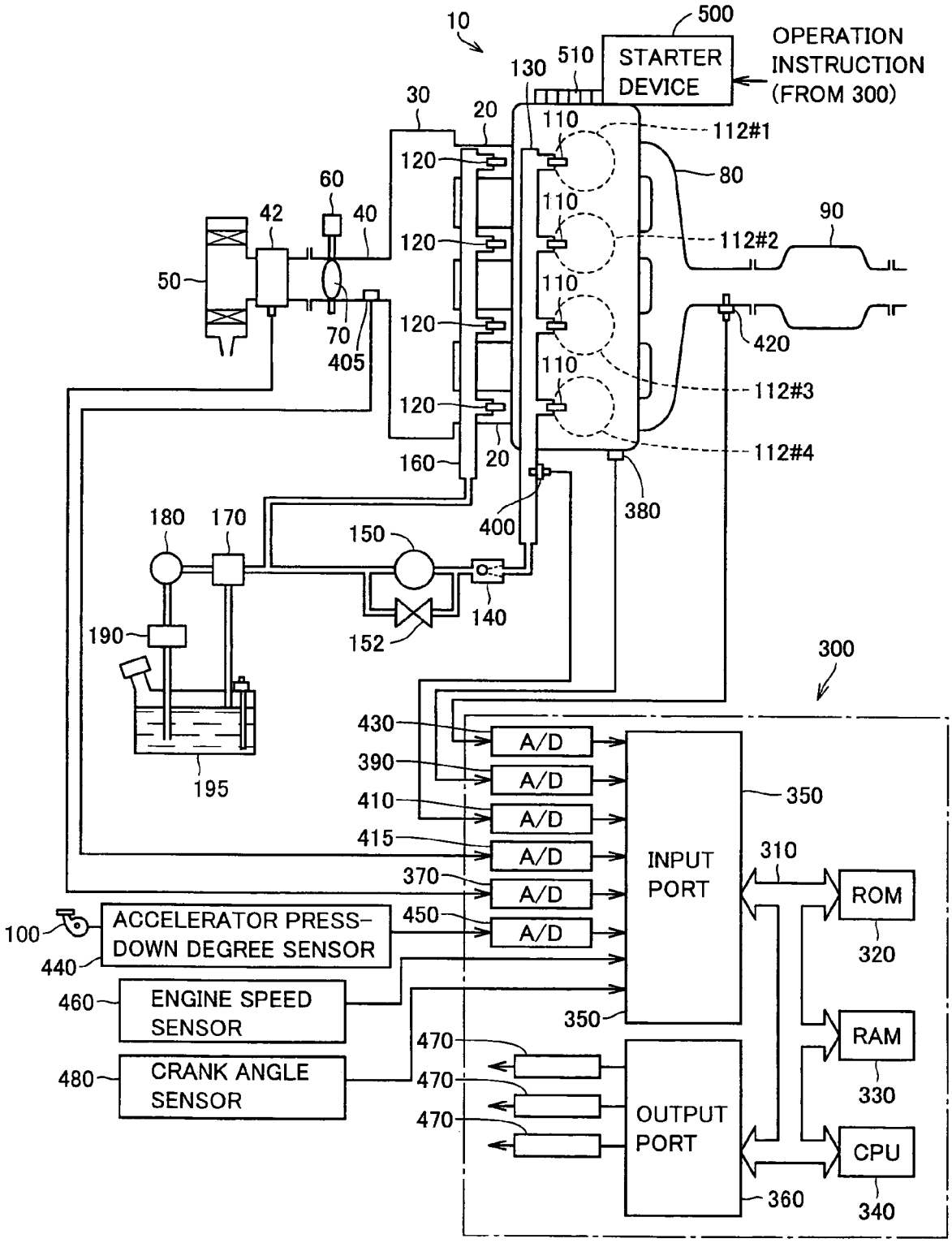
FIG. 1 is a schematic configuration diagram of an engine system that is controlled by an engine ECU (Electronic Control Unit) identified as a control apparatus for an internal combustion engine according to an embodiment of the present invention.

Hereinafter, embodiments of the present invention will be described in detail with reference to the drawings. In the following, the same or corresponding portions in the drawings have the same reference characters allotted, and detailed description thereof will not be repeated where appropriate.

First Embodiment

FIG. 1 is a schematic configuration diagram of an engine system that is controlled by an engine ECU (Electronic Control Unit) implementing the control apparatus for an internal combustion engine according to embodiments of the present invention. Although an in-line 4-cylinder gasoline engine is shown in FIG. 1, application of the present invention is not restricted to the engine shown.

As shown in FIG. 1, the engine (internal combustion engine) 10 is provided with four cylinders 112#1-112#4. Hereinafter, cylinders 112#1-112#4 may collectively be referred to as cylinder 112 or cylinders 112.

Cylinders 112 are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its degree of opening controlled based on an output signal of an engine ECU 300, independently from an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake manifold and/or an intake port are provided. Injectors 110 and 120 are controlled based on output signals from engine ECU 300.

Although an internal combustion engine having two kinds of injectors separately provided is explained in the present embodiment, the present invention is not restricted to such an internal combustion engine. For example, the internal combustion engine may have one injector that can effect both in-cylinder injection and intake manifold injection.

As shown in FIG. 1, in-cylinder injectors 110 are connected to a common fuel delivery pipe 130. Fuel delivery pipe 130 is connected to a high-pressure fuel pump 150 of an engine-driven type, via a check valve 140 that allows a flow in the direction toward fuel delivery pipe 130. The discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

Intake manifold injectors 120 are connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 195. Fuel pressure regulator 170 is configured to return a part of the fuel discharged from low-pressure fuel pump 180 back to fuel tank 195 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a theoretical air-fuel ratio.

Accelerator pedal 100 is connected to an accelerator press-down degree sensor 440 that generates an output voltage proportional to the degree of press-down of accelerator pedal 100. The output voltage of accelerator press-down degree sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and the engine speed obtained by the above-described accelerator press-down degree sensor 440 and engine speed sensor 460, respectively, and the correction values based on the engine coolant temperature.

Further, an ambient temperature sensor 405 is provided at a given place in an intake path extending to intake duct 40, surge tank 30 and intake manifold 20. Ambient temperature sensor 405 generates an output voltage corresponding to an intake air temperature, which voltage is input via an A/D converter 415 to input port 350.

A crank angle sensor 480 is formed of a rotor attached to a crankshaft of engine 10 and an electromagnetic pickup, arranged in the vicinity of the rotor, for detecting the passage of a projection provided at the outer periphery of the rotor. Crank angle sensor 480 detects the rotational phase (crank angle) of the crankshaft. The output of crank angle sensor 480 is provided to input port 350 as a pulse signal that is generated each time the projection of the rotor passes the sensor.

Engine ECU 300 generates various control signals for controlling the overall operations of the engine system based on signals from the respective sensors by executing a prescribed program. The control signals are transmitted to the devices and circuits constituting the engine system via output port 360 and drive circuits 470.

In engine 10 according to the embodiment of the present invention, both of in-cylinder injector 110 and intake manifold injector 120 are provided for each cylinder 112. Thus, it is necessary to control a fuel injection ratio between in-cylinder injector 110 and intake manifold injector 120 with respect to a total fuel injection quantity required, having been calculated as described above. Of engine ECU 300, a functional portion related to fuel injection control of injectors 110 and 120, including the control of the fuel injection ratio therebetween, corresponds to the "fuel injection control means" of the present invention.

In the following, the fuel injection ratio between the injectors will be represented as a DI (Direct Injection) ratio r, which is a ratio of the quantity of the fuel injected from in-cylinder injector 110 with respect to a total fuel injection quantity. More specifically, "DI ratio r=100%" means that fuel is injected only from in-cylinder injector 110, and "DI ratio r=0%" means that fuel is injected only from intake manifold injector 120. "DI ratio r≠0%", "DI ratio r≠100%", and "0%<DI ratio r<100%" each mean that fuel injection is carried out using both in-cylinder injector 110 and intake manifold injector 120. Generally, in-cylinder injector 110 contributes to an increase of output performance, with improved anti-knock performance by virtue of latent heat of vaporization. Intake manifold injector 120 contributes to the increase of output performance, with suppression of variation in revolution (torque) by virtue of improved homogeneity of the air-fuel mixture.

Further, a starter device 500 is provided for engine 10. Generally, starter device 500 is formed of an electric motor that is electrified in response to an operation instruction from engine ECU 300. For example, when an ignition switch is turned on by a key manipulation of the driver, engine ECU 300 generates an operation instruction of starter device 500. In a hybrid vehicle or a vehicle incorporating an economic running system where the engine is operated intermittently, engine ECU 300 automatically generates an actuation instruction of starter device 500 in accordance with an operation state, a state of charge of the battery, or the like.

When an operation instruction is generated from engine ECU 300, starter device 500 drives and rotates a flywheel 510 of engine 10 so as to start engine 10. When the engine speed has reached a prescribed engine speed permitting injection, fuel injection and ignition are carried out to start driving of the engine by fuel combustion.

Hereinafter, the structure of the engine will further be described with reference to FIG. 2.

Figure 2:
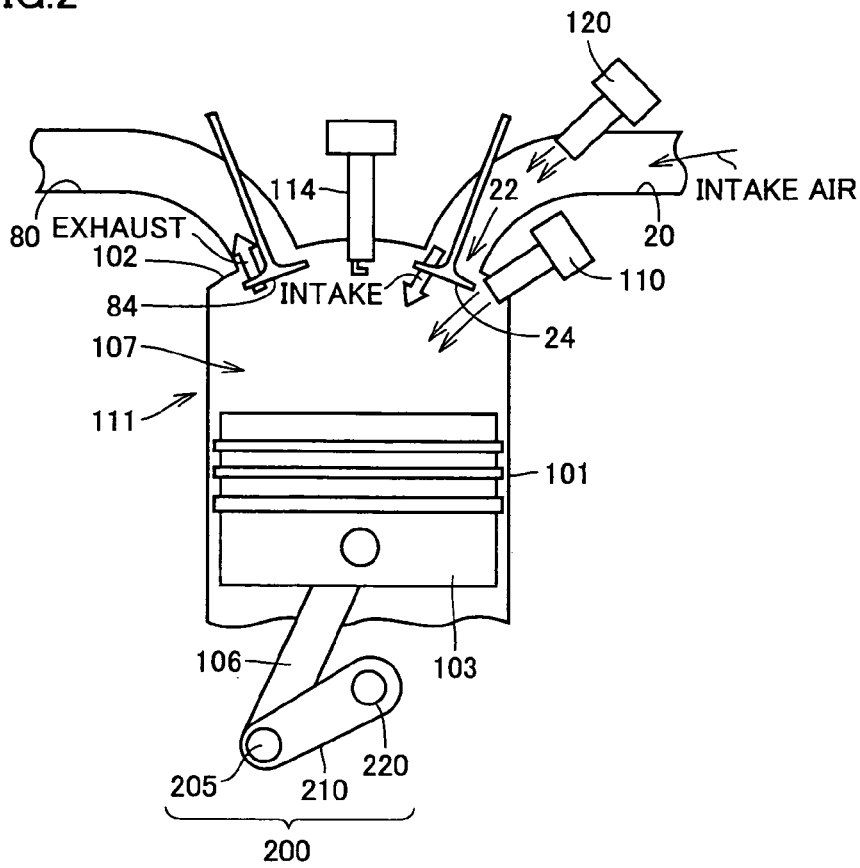
FIG. 2 illustrates a configuration of the engine shown in FIG. 1.

Referring to FIG. 2, each cylinder is configured with a cylinder 111 including a cylinder block 101 and a cylinder head 102 connected above cylinder block 101, and a piston 103 that performs a reciprocating motion in cylinder 111.

In cylinder 111, the inner wall of cylinder block 101 and cylinder head 102 and the top surface of piston 103 constitute the partition for a combustion chamber 107 in which air-fuel mixture is burned. Cylinder head 102 is provided with a spark plug 114 protruding into combustion chamber 107 to ignite the air-fuel mixture, and an in-cylinder injector 110 injecting fuel into combustion chamber 107. An intake manifold injector 120 is further provided, which is arranged to inject fuel into an intake manifold 20 and/or an intake port 22 that is the communicating section between intake manifold 20 and combustion chamber 107.

The air-fuel mixture including the fuel injected into intake manifold 20 and/or intake port 22 is introduced into combustion chamber 107 while an intake valve 24 is open. The exhaust gas after the fuel burning by ignition of spark plug 114is delivered via an exhaust manifold 80 to a three-way catalytic converter 90 while an exhaust valve 84 is open.

With burning of the fuel within combustion chamber 107, piston 103 moves up and down inside cylinder 111. This piston 103 is connected via a connecting rod 106 to a crankshaft 200 that is the output shaft of engine 10. Crankshaft 200 includes a crank pin 205, a crank arm 210, and a crank journal 220.

Figure 3:
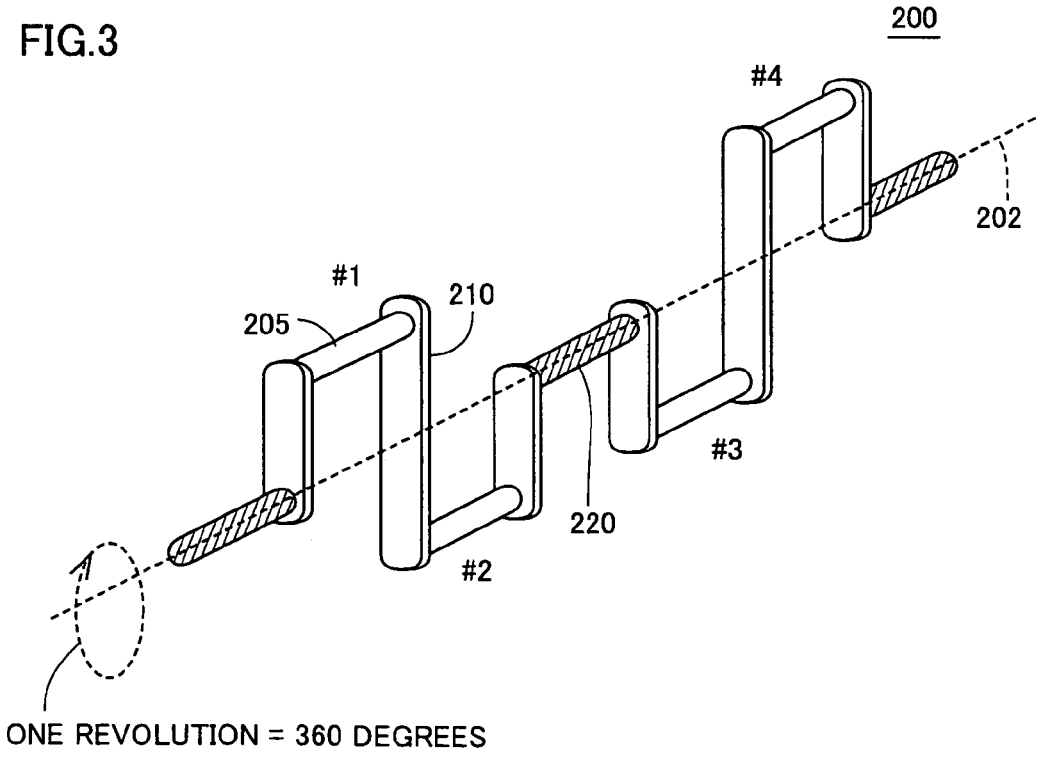
FIG. 3 is a schematic diagram illustrating a configuration of a crankshaft to which cylinders are connected.

As shown in FIG. 3, crankshaft 200 is provided commonly for cylinders 112 of engine 10. Each of cylinders 112#1-112#4 is connected to crankshaft 200 via one end of connecting rod 106 connected to crank pin 205. Crank journal 220 corresponds to the main axis of crankshaft 200. Crank arm 210 connects crank pin 205 with crank journal 220.

With this configuration, the reciprocating motion of piston 103 in each of sequentially ignited cylinders 112#1-112#4 is converted into a rotary motion of crankshaft 200 about a crank rotation axis 202.

Figures 4, 5:
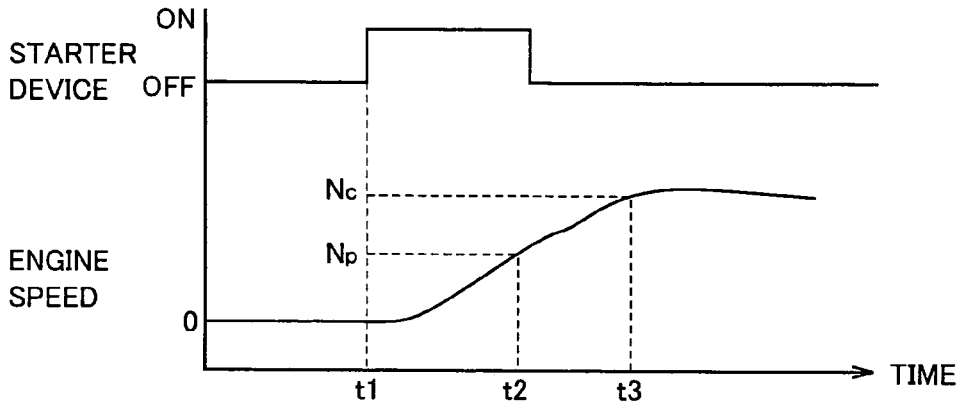
FIG. 4 illustrates combustion cycles of the cylinders.
FIG. 5 is an operation waveform diagram at the time of engine startup.

As shown in FIG. 4, one combustion cycle of each cylinder 112 is formed of intake, compression, combustion and exhaust strokes. Each stroke corresponds to the crank rotation angle of 180 degrees. Cylinders 112#1-112#4 are ignited sequentially in order of, e.g., #1, #2, #4 and #3, and the four strokes are carried out sequentially in each cylinder. Two revolutions (720 degrees) of crankshaft 200 correspond to one combustion cycle of the engine. Crank angle sensor 480 shown in FIG. 1 may be mounted to crankshaft 200 to detect the phase, or rotation angle, of crankshaft 200 (hereinafter, referred to as "crank rotation angle") within the range of 0-720 degrees at a pitch of prescribed angle that corresponds to the arrangement pitch of the projections of the rotor.

Hereinafter, startup-time fuel injection control during the engine cold state according to the first embodiment of the present invention will be described.

Referring to FIG. 5, at time t1, starter device 500 is turned on by manipulation of a starter switch or the like by a driver. In response, the engine speed begins to increase by the driving force of starter device 500. At time t2, the engine speed reaches an engine speed Np permitting fuel injection by the driving force of starter device 500, and thus, driving of engine 10 by fuel combustion is initiated. Starter device 500 is turned off at around this timing.

As the engine speed is further increased by the fuel injection, it reaches at time t3 an engine speed Nc by which it is determined that the startup has completed. The startup-time fuel injection control is then terminated. Thereafter, fuel injection control in a normal operation mode in response to an output request to engine 10 is carried out based on a throttle opening degree corresponding to the accelerator press-down degree or the like.

Figure 6:
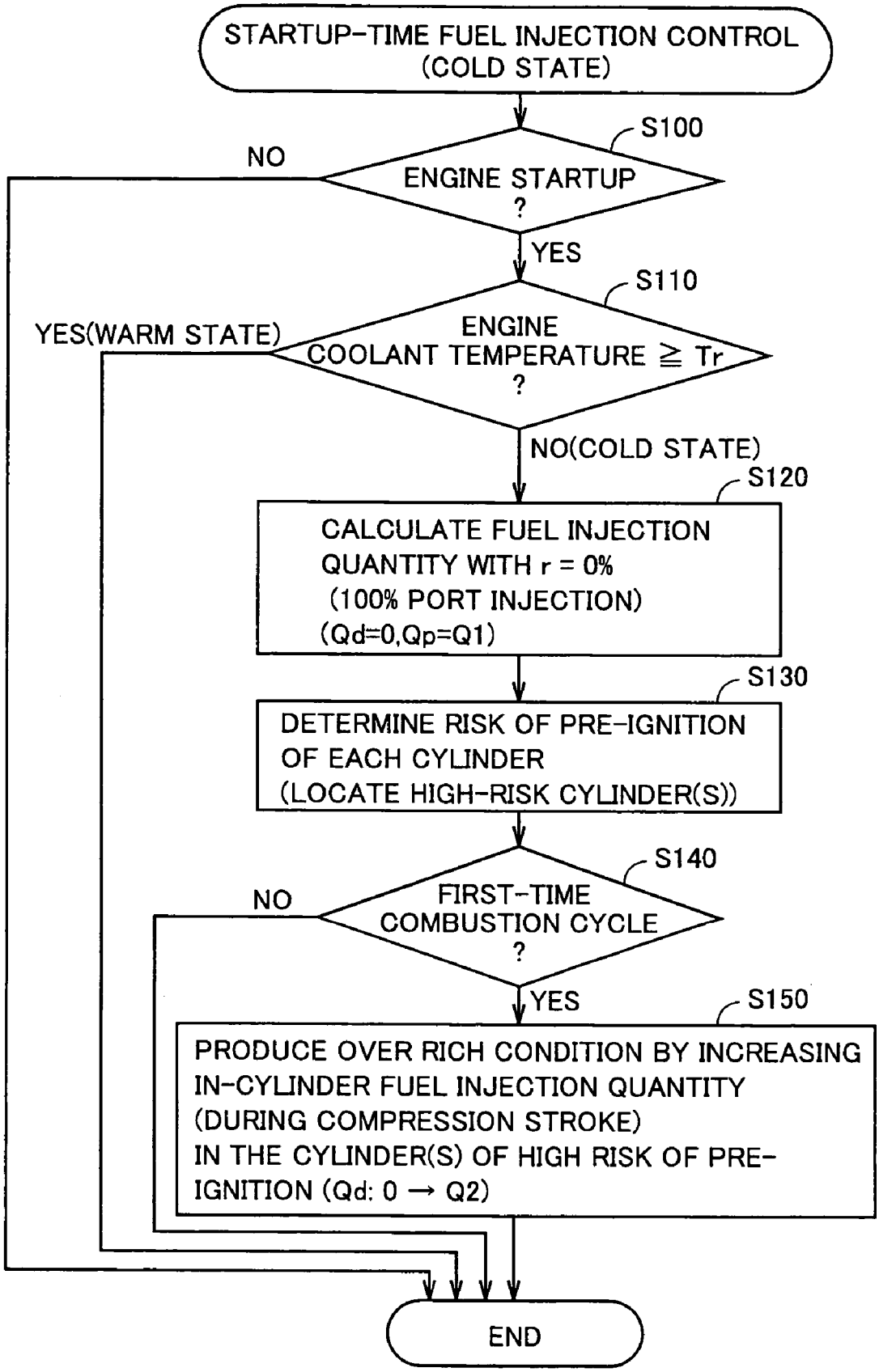
FIG. 6 is a flowchart illustrating startup-time fuel injection control during an engine cold state according to a first embodiment of the present invention.

FIG. 6 is a flowchart illustrating the startup-time fuel injection control during the engine cold state according to the first embodiment of the present invention. A program for implementing the flowchart shown in FIG. 6 is prestored in engine ECU 300. The startup-time fuel injection control of the first embodiment is carried out when the relevant program is activated at the time of engine startup.

Referring to FIG. 6, the startup-time fuel injection control is carried out at the time of engine startup, i.e., from time t1 to time t3 in FIG. 5 (step S100). The determination in step S100 is made, e.g., based on the engine speed. More specifically, in step S100, it is determined to be at the time of "engine startup" during the period from the time (time t1) when the engine startup process was initiated to the time (time t3) when the engine speed has reached the engine speed Nc with which it is determined the startup has completed. During the remaining period (NO in step S100), the startup-time fuel injection control is not carried out.

At the time of engine startup (YES in step S 100), the temperature of engine 10 is determined based, e.g., on an engine coolant temperature measured by coolant temperature sensor 380.

During the engine cold state, for example when the engine coolant temperature is lower than a reference temperature Tr (NO in step S110), steps S120-S150 as will be described below are carried out sequentially, to conduct the startup-time fuel injection control during the engine cold state according to the first embodiment. During the engine warm state, for example when the engine coolant temperature is equal to or higher than reference temperature Tr (YES in step S110), the startup-time fuel injection control shown in FIG. 6 is not carried out.

During the engine cold state, vaporization of the fuel within the cylinder is unlikely to be promoted, so that it is preferable to avoid fuel injection from in-cylinder injector 110. Thus, the quantity of the fuel to be injected is calculated with DI ratio r=0% (i.e., 100% port injection). In response, the in-cylinder fuel injection quantity Qd is set to 0, while the port fuel injection quantity Qp is set to Q1. The prescribed quantity Q1 corresponds to a total fuel injection quantity required at the time of engine startup (step S120).

Further, a risk of pre-ignition in each cylinder is determined based on the stopped position of piston 103 at the time of previous engine stop to locate the cylinder(s) having a high risk of occurrence of pre-ignition from among cylinders 112#1 -112#4 (step S130).

In the cylinder that was before or during the compression stroke at the time of previous engine stop, the air-fuel ratio within combustion chamber 107 may increase due to the fuel leaked from in-cylinder injector 110 during the engine stop. Such residual fuel may be compressed by the compression operation of piston 103 when the engine startup operation is initiated, leading to a high risk of occurrence of unintended pre-ignition. Thus, for each cylinder, the stopped position of piston 103 is estimated by a combination of the crank rotation angle at the time of previous engine stop and the estimation of the inertial behavior of piston 103 during the engine stop, to set a crank rotation angle range in which the risk of occurrence of pre-ignition is high. More specifically, the risk of occurrence of pre-ignition in each cylinder may be determined according to which phase of crank rotation angles 0-720 degrees, corresponding to two revolutions of crankshaft 200, crankshaft 200 stopped at upon previous engine stop. That is, the cylinder(s) having a high risk of pre-ignition can be located from among cylinders 112#1-112#4 by providing engine ECU 300 with a mechanism for storing and retaining the crank rotation angle of each cylinder at the time of engine stop and by determining in step S130 whether the crank rotation angle at the time of previous engine step falls within the high-risk range described above.

The processing in steps S100-S130 is triggered by initiation of the engine startup operation (time t1). This ensures that the determination as to the risk of occurrence of pre-ignition can be finished by time t2 at which the engine speed reaches engine speed Np permitting fuel injection (FIG. 5) and actual fuel injection is initiated.

When the engine speed reaches engine speed Np permitting fuel injection, driving of the engine by fuel injection is initiated. At this time, in the first-time combustion cycle (YES in step S140), in the cylinder(s) with the high risk of pre-ignition determined in step S130, fuel injection from in-cylinder injector 110 is carried out during the compression stroke, in addition to the fuel injection from intake manifold injector 120 (Q1) having been set in step S120.

As such, the in-cylinder fuel injection quantity, originally Qd=0, is set to Qd=Q2 in the cylinder(s) with the high risk of pre-ignition. The prescribed quantity Q2 is set such that during the first-time compression stroke, the air-fuel mixture within combustion chamber 107 becomes over rich to make the air-fuel ratio out of the range enabling combustion (e.g., A/F of about 8-9 or more) (step S150).

The determination as to whether it is the first-time combustion cycle or not can be made by checking, in each cylinder 112, presence/absence of passage of the crank rotation angle corresponding to the top dead center (TDC) after time t2 when fuel injection is initiated. That is, it is determined "NO" in step S140 for cylinder 112 having reached the top dead center (TDC) after time t2.

In the cylinder(s) other than those in the first-time combustion cycle, and in the first-time combustion cycle of the cylinder(s) other than those with the high risk of pre-ignition, the setting of fuel injection made in step S120 is employed without alteration. That is, port injection alone is carried out, without additional in-cylinder injection (Qp=Q1, Qd=0). In the cylinder(s) at which additional in-cylinder fuel injection was carried out, the over-rich gas within the combustion chamber is exhausted from exhaust valve 84 during the exhaust stroke of the first-time combustion cycle. Thus, from the next combustion cycle, the fuel injection is carried out in accordance with the setting of step S120.

In the flowchart shown in FIG. 6, step S120 corresponds to the "startup-time control means" of the present invention. Step S130 corresponds to the "pre-ignition detecting means", and step S150 corresponds to the "pre-ignition preventing means" of the present invention.

According to the startup-time fuel injection control described above, during the engine cold state, engine startup is carried out basically with port injection, to suppress degradation in exhaust emission performance as well as degradation in lubrication performance due to dilution of the lubricating oil. Further, in the cylinder(s) having a high risk of occurrence of pre-ignition, in-cylinder injection is additionally carried out to prevent occurrence of pre-ignition. This ensures smooth startup of the engine.

Although the determination of risk of pre-ignition may be made by another method, e.g., by arranging an air-fuel ratio sensor in the combustion chamber of each cylinder 112, for example, the above-described determination method based on the crank rotation angle at the time of previous engine stop ensures efficient determination, without the need of provision of any new sensors.

In the first embodiment, explanation was made about the startup-time fuel injection control for preventing pre-ignition during the engine cold state where the engine has been stopped for a long time and pre-ignition is more likely to occur. The similar control however is possible during the engine warm state as well. During the engine warm state, the fuel injection ratio is preferably set to: DI ratio r=100% (i.e., 100% in-cylinder injection), as will be described in detail below. Thus, in the cylinder(s) having been determined to have a high risk of pre-ignition in the process corresponding to step S130 of FIG. 6, port injection from intake manifold injector 120 is additionally carried out in the first-time combustion cycle, to control fuel injection such that the gas within the combustion chamber becomes over rich. As such, occurrence of pre-ignition can be prevented during the engine warm state as well, to realize smooth startup of the engine.

In other words, according to the startup-time fuel injection control of the first embodiment of the present invention, at the time of engine startup, fuel injection is basically carried out using one of in-cylinder injector 110 and intake manifold injector 120, and in the cylinder(s) of high risk of pre-ignition, additional fuel injection is carried out using the injector that is not basically used at the time of engine startup. In this manner, pre-ignition can be prevented during both the engine cold state and the engine warm state, to ensure smooth engine startup.

Second Embodiment

In the second embodiment of the present invention, startup-time fuel injection control in the engine system shown in FIG. 1 for ensuring smooth startup of the engine by preventing occurrence of knocking during the engine warm state will be described.

Figure 7:
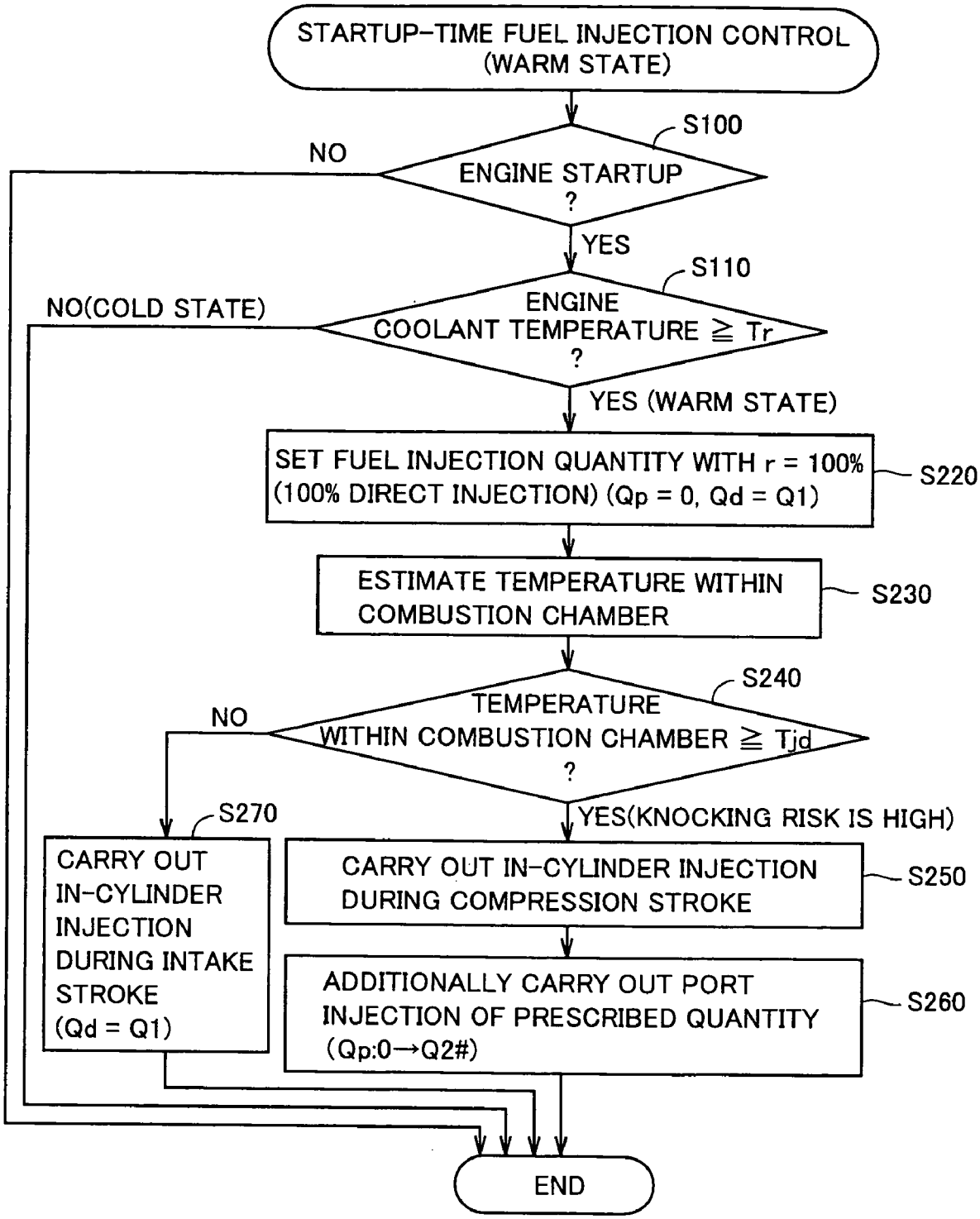
FIG. 7 is a flowchart illustrating startup-time fuel injection control during an engine warm state according to a second embodiment of the present invention.

FIG. 7 is a flowchart illustrating startup-time fuel injection control during the engine warm state according to the second embodiment of the present invention. The startup-time fuel injection control shown in FIG. 7 is also carried out by activation of a program prestored in engine ECU 300.

Referring to FIG. 7, steps S100 and S110 are identical to those shown in FIG. 6. When YES in step S110 (i.e., during the engine warm state), the following steps S220-S270 are carried out.

At the time of engine startup during the engine warm state, if fuel injection is carried out solely from intake manifold injector 120, in-cylinder injector 110 will be constantly exposed to high-temperature combustion gas, and the cooling effect by vaporization of the injected fuel cannot be obtained. The tip end of the injector 110 will attain a high temperature, and fuel will be deposited in its injection hole. Thus, it is preferable to conduct fuel injection via in-cylinder injector 110 during the engine warm state. Accordingly, the fuel injection ratio is set to DI ratio r=100% (i.e., 100% in-cylinder injection) at the time of engine startup during the engine warm state. This means that port fuel injection quantity Qp is set to 0, while in-cylinder fuel injection quantity Qd is set to Q1 (step S220).

Further, at the time of engine startup during the engine warm state, a temperature within the combustion chamber is estimated (step S230). Estimation of the temperature within combustion chamber 107 is carried out based on a prescribed function expression or a table in accordance with at least one of the engine coolant temperature and the intake air temperature (detected by ambient temperature sensor 405). That is, a risk of occurrence of knocking is determined based on the engine coolant temperature or the intake air temperature, or based on a combination thereof The temperature within the combustion chamber estimated in step S230 is compared with a judgment temperature Tjd for judgment of the risk of occurrence of knocking (step S240). Judgment temperature Tjd may be determined in advance through an experiment with an actual device to confirm presence/absence of occurrence of knocking, for example.

If the temperature within the combustion chamber is lower than judgment temperature Tjd (NO in step S240), it is determined that "knocking risk is low", in which case fuel of in-cylinder fuel injection quantity Qd having been set in step S220 is injected from in-cylinder injector 10 during an intake stroke so as to improve homogeneity of the air-fuel mixture for stabilization of combustion (step S270).

If the temperature within the combustion chamber is equal to or higher than judgment temperature Tjd (YES in step S240), it is determined that "knocking risk is high", in which case the process proceeds to step S250. In step S250, the quantity of the fuel injected from in-cylinder injector 110 is set such that the cooling effect within the combustion chamber by virtue of vaporization of the injected fuel increases. For example, the timing of fuel injection from in-cylinder injector 110 is set such that the fuel of in-cylinder fuel injection quantity Qd having been set in step S220 is injected during the compression stroke.

When the in-cylinder injection is carried out during the compression stroke, the time from the fuel injection to the timing of ignition is reduced, which can enhance the cooling effect within the combustion chamber by vaporization of the injected fuel. In this manner, the temperature within the combustion chamber can be decreased, and thus, the risk of knocking is suppressed.

It is unlikely that only some of the cylinders would suffer the temperature increase in the combustion chamber that would lead to occurrence of knocking. Thus, in the flowchart shown in FIG. 7, the processes in steps S230-S270 are carried out commonly for the cylinders. However, if temperature sensors are additionally arranged to make it possible to estimate the temperature in the combustion chamber for each cylinder, the processes in steps S230-S270 may be carried out independently for respective cylinders 112#1-112#4.

Cylinder 112 for which in-cylinder injection has been carried out during the compression stroke may suffer a decrease of engine output torque. Thus, in the relevant cylinder, port fuel injection of a prescribed quantity is additionally carried out so as to compensate for the decreased output torque (step S260). Specifically, port fuel injection quantity Qp having been set in step S220 is changed from Qp=0 to Qp=Q2# (prescribed value).

When the fuel injection is carried out according to the fuel injection settings in steps S260 and S270, smooth engine startup becomes possible by reducing the risk of knocking by conducting in-cylinder injection during the compression stroke and by compensating for variation in output torque. Although it has been described that additional port-injection in step S260 follows the in-cylinder injection during the compression stroke in step S250 for convenience of explanation, the port injection during the intake stroke (S260) may be actually carried out prior to the in-cylinder injection during the compression stroke (S250).

According to the startup-time fuel injection control described above, engine startup is carried out basically with in-cylinder injection during the engine warm state to prevent clogging of in-cylinder injector 10, and at the same time, the risk of knocking can be reduced. Further, it is possible to ensure smooth engine startup by compensating for variation in output torque that would occur when the in-cylinder injection is carried out during the compression stroke for the purpose of preventing knocking.

Figure 8:
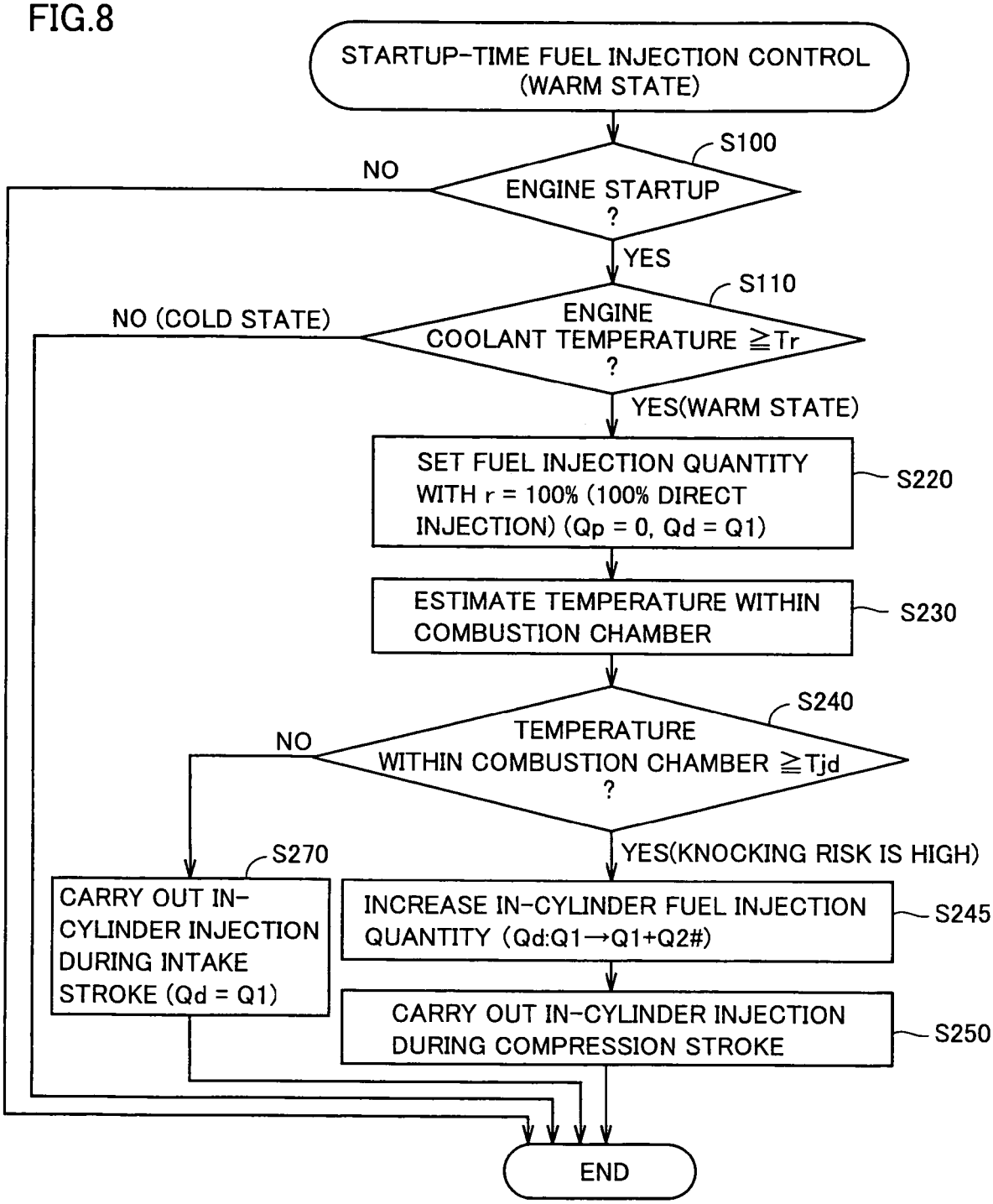
FIG. 8 is a flowchart illustrating another example of the startup-time fuel injection control during the engine warm state according to the second embodiment of the present invention.

Alternatively, the compensation for the engine output torque when it is determined that knocking risk is high may be carried out using another method, as shown in FIG. 8.

Referring to FIG. 8, it is possible to carry out a step S245 prior to step S250, in place of step S260 shown in FIG. 7. In step S245, in-cylinder fuel injection quantity Qd itself is increased for the purpose of compensating for a decrease of the engine output torque that is expected when in-cylinder injection is carried out during the compression stroke in step S250.

More specifically, in-cylinder fuel injection quantity Qd is changed from prescribed quantity Q1 at the time of engine startup having been set in step S220 to "Q1+Q2#" added with a prescribed quantity Q2# for correction of output torque. The processes in the other steps in the flowchart of FIG. 8 are similar to those in the startup-time fuel injection control shown in FIG. 7, and thus, detailed description thereof is not repeated.

According to the startup-time fuel injection control in FIG. 8 as well, smooth engine startup is ensured by suppressing occurrence of knocking during the engine warm state and by preventing a decrease of the output torque, as in the case of the startup-time fuel injection control shown in FIG. 7.

In the flowcharts in FIGS. 7 and 8, step S220 corresponds to the "startup-time control means" of the present invention. Further, steps S230, S240 correspond to the "knocking detecting means", step S250 corresponds to the "knocking preventing means", and steps S245, S260 correspond to the "startup-time fuel injection correction means" of the present invention.

Further, in step S250 shown in FIG. 7, in-cylinder fuel injection quantity Qd may be increased while maintaining the timing of the in-cylinder injection within the intake stroke, by setting the fuel injection from in-cylinder injector 110 such that the cooling effect within the combustion chamber by virtue of vaporization of the injected fuel is enhanced. In this case, step S260 for correction of output torque may be omitted as required.

In the second embodiment, the startup-time fuel injection control for preventing knocking during the engine warm state where such knocking is more likely to occur has been explained. The similar control can also be carried out during the engine cold state. As shown in the first embodiment, during the engine cold state, it is preferable to set the fuel injection ratio to DI ratio r=0% (i.e., 100% in-cylinder injection). Therefore, when the knocking risk is high during the engine cold state (YES in step S240), additional fuel injection via in-cylinder injector 110 may be carried out as the process corresponding to step S250 in FIG. 7, so as to enhance the cooling effect within the combustion chamber by vaporization of the injected fuel. In this case, the process corresponding to step S260 for correction of output torque may be omitted as required. Accordingly, during the engine cold state as well, smooth engine startup can be realized by preventing occurrence of knocking.

As described above, according to the startup-time fuel injection control of the second embodiment of the present invention, in the case where the knocking risk is high at the time of engine startup, the quantity of the fuel injected from in-cylinder injector 110 is set such that the cooling effect within the combustion chamber by vaporization of the injected fuel is increased. Accordingly, it is possible to reduce the risk of knocking during both the engine cold state and the engine warm state to ensure smooth engine startup.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having first fuel injection means for injecting fuel into a combustion chamber and second fuel injection means for injecting fuel into an intake manifold for a cylinder, comprising:

fuel injection control means for controlling fuel injection from said first and second fuel injection means; and pre-ignition detecting means for detecting a risk of pre-ignition during a first-time compression stroke of the cylinder, at the time of startup of said internal combustion engine, based on a stopped position of a piston at the time of previous stop of said internal combustion engine; wherein said fuel injection control means includes startup-time control means for causing one of said first and second fuel injection means to inject fuel of a quantity required for operation of said internal combustion engine at the time of startup of said internal combustion engine, and pre-ignition preventing means for causing the other one of said first and second fuel injection means to inject fuel of a prescribed quantity that is set to make an air-fuel ratio within said combustion chamber become out of a range enabling combustion when said pre-ignition detecting means detects a high risk of said pre-ignition.

2. The control apparatus for an internal combustion engine according to claim 1, wherein said startup-time control means causes said second fuel injection means to inject fuel of the quantity required for operation of said internal combustion engine at the time of startup of said internal combustion engine during a cold state, and said pre-ignition preventing means causes said first fuel injection means to inject fuel of said prescribed quantity during said first-time compression stroke when said pre-ignition detecting means detects a high risk of said pre-ignition at the time of startup of said internal combustion engine during said cold state.

3. The control apparatus for an internal combustion engine according to claim 1, wherein said pre-ignition detecting means detects the risk of pre-ignition by estimating the stopped position of said piston from an output of a crank angle sensor at the time of previous stop of said internal combustion engine.

4. The control apparatus for an internal combustion engine according to claim 1, wherein said internal combustion engine has a plurality of said cylinders, and said pre-ignition detecting means selectively identifies a cylinder having a high risk of pre-ignition from among said plurality of cylinders.

5. A control apparatus for an internal combustion engine having first fuel injection means for injecting fuel into a combustion chamber and second fuel injection means for injecting fuel into an intake manifold for a cylinder, comprising:

fuel injection control means for controlling fuel injection from said first and second fuel injection means; and knocking detecting means for detecting a risk of occurrence of knocking in the cylinder, at the time of startup of said internal combustion engine, based on a temperature within said combustion chamber; wherein said fuel injection control means includes startup-time control means for causing at least one of said first and second fuel injection means to inject fuel of a quantity required for operation of said internal combustion engine at the time of startup of said internal combustion engine, and knocking preventing means, operative upon detection of a high risk of occurrence of said knocking by said knocking detecting means at the time of startup of said internal combustion engine, for setting fuel injection from said first fuel injection means such that a cooling effect within the combustion chamber by vaporization of the injected fuel is enhanced.

6. The control apparatus for an internal combustion engine according to claim 5, wherein said startup-time control means causes said first fuel injection means to inject fuel of the quantity required for operation of said internal combustion engine at the time of startup of said internal combustion engine during a warm state, and said knocking preventing means sets the fuel injection from said first fuel injection means to be carried out during a compression stroke at the time of startup of said internal combustion engine during said warm state.

7. The control apparatus for an internal combustion engine according to claim 6, wherein said fuel injection control means further includes startup-time fuel injection correction means for increasing the quantity of the fuel injected from said first fuel injection means at the time when said knocking preventing means is in operation than at the time when said knocking preventing means is not in operation.

8. The control apparatus for an internal combustion engine according to claim 6, wherein said fuel injection control means further includes startup-time fuel injection correction means for causing injection of fuel of a prescribed quantity from said second fuel injection means to be carried out in addition to injection of the fuel of the quantity required for operation of said internal combustion engine from said first fuel injection means at the time when said knocking preventing means is in operation.

9. The control apparatus for an internal combustion engine according to claim 5, wherein said knocking detecting means detects the risk of occurrence of said knocking based on at least one of a coolant temperature and an intake air temperature of said internal combustion engine.

10. A control apparatus for an internal combustion engine having a first fuel injection mechanism for injecting fuel into a combustion chamber and a second fuel injection mechanism for injecting fuel into an intake manifold for a cylinder, comprising:

a fuel injection control portion for controlling fuel injection from said first and second fuel injection mechanisms; and a pre-ignition detecting portion for detecting a risk of pre-ignition during a first-time compression stroke of the cylinder, at the time of startup of said internal combustion engine, based on a stopped position of a piston at the time of previous stop of said internal combustion engine; wherein said fuel injection control portion includes a startup-time control portion for causing one of said first and second fuel injection mechanisms to inject fuel of a quantity required for operation of said internal combustion engine at the time of startup of said internal combustion engine, and a pre-ignition preventing portion for causing the other one of said first and second fuel injection mechanisms to inject fuel of a prescribed quantity that is set to make an air-fuel ratio within said combustion chamber become out of a range enabling combustion when said pre-ignition detecting portion detects a high risk of said pre-ignition.

11. The control apparatus for an internal combustion engine according to claim 10, wherein said startup-time control portion causes said second fuel injection mechanism to inject fuel of the quantity required for operation of said internal combustion engine at the time of startup of said internal combustion engine during a cold state, and said pre-ignition preventing portion causes said first fuel injection mechanism to inject fuel of said prescribed quantity during said first-time compression stroke when said pre-ignition detecting portion detects a high risk of said pre-ignition at the time of startup of said internal combustion engine during said cold state.

12. The control apparatus for an internal combustion engine according to claim 10, wherein said pre-ignition detecting portion detects the risk of pre-ignition by estimating the stopped position of said piston from an output of a crank angle sensor at the time of previous stop of said internal combustion engine.

13. The control apparatus for an internal combustion engine according to claim 10, wherein said internal combustion engine has a plurality of said cylinders, and said pre-ignition detecting portion selectively identifies a cylinder having a high risk of pre-ignition from among said plurality of cylinders.

14. A control apparatus for an internal combustion engine having a first fuel injection mechanism for injecting fuel into a combustion chamber and a second fuel injection mechanism for injecting fuel into an intake manifold for a cylinder, comprising:

a fuel injection control portion for controlling fuel injection from said first and second fuel injection mechanisms; and a knocking detecting portion for detecting a risk of occurrence of knocking in the cylinder, at the time of startup of said internal combustion engine, based on a temperature within said combustion chamber; wherein said fuel injection control portion includes a startup-time control portion for causing at least one of said first and second fuel injection mechanisms to inject fuel of a quantity required for operation of said internal combustion engine at the time of startup of said internal combustion engine, and a knocking preventing portion, operative upon detection of a high risk of occurrence of said knocking by said knocking detecting portion at the time of startup of said internal combustion engine, for setting fuel injection from said first fuel injection mechanism such that a cooling effect within the combustion chamber by vaporization of the injected fuel is enhanced.

15. The control apparatus for an internal combustion engine according to claim 14, wherein said startup-time control portion causes said first fuel injection mechanism to inject fuel of the quantity required for operation of said internal combustion engine at the time of startup of said internal combustion engine during a warm state, and said knocking preventing portion sets the fuel injection from said first fuel injection mechanism to be carried out during a compression stroke at the time of startup of said internal combustion engine during said warm state.

16. The control apparatus for an internal combustion engine according to claim 15, wherein said fuel injection control portion further includes a startup-time fuel injection correction portion for increasing the quantity of the fuel injected from said first fuel injection mechanism at the time when said knocking preventing portion is in operation than at the time when said knocking preventing portion is not in operation.

17. The control apparatus for an internal combustion engine according to claim 15, wherein said fuel injection control portion further includes a startup-time fuel injection correction portion for causing injection of fuel of a prescribed quantity from said second fuel injection mechanism to be carried out in addition to injection of the fuel of the quantity required for operation of said internal combustion engine from said first fuel injection mechanism at the time when said knocking preventing portion is in operation.

18. The control apparatus for an internal combustion engine according to claim 14, wherein said knocking detecting portion detects the risk of occurrence of said knocking based on at least one of a coolant temperature and an intake air temperature of said internal combustion engine.

* * * * *